United States Patent [19]

van der Merwe et al.

[11] Patent Number: 4,762,458

[45] Date of Patent: Aug. 9, 1988

[54] BOTTOM DISCHARGE HOPPER

[76] Inventors: Deon A. van der Merwe; Brian A. Steinhobel, both of 9 Rose Rd., Upper Houghton, Johannesburg, Transvaal Province, South Africa, 2196

[21] Appl. No.: 28,444

[22] Filed: Mar. 20, 1987

[51] Int. Cl.[4] ..... B61D 7/30

[52] U.S. Cl. ..... 414/378; 105/250; 105/280; 222/505; 222/556; 414/387

[58] Field of Search ..... 222/505, 556, 558; 105/250, 280, 282.1; 414/378, 387, 388, 402

[56] References Cited

U.S. PATENT DOCUMENTS 3,459,316 8/1969 McGrath ..... 414/388
4,207,020 6/1980 Schuller ..... 414/378

FOREIGN PATENT DOCUMENTS 38403 10/1981 European Pat. Off. ..... 105/280
189885 3/1967 U.S.S.R. ..... 105/250

*Primary Examiner*—Robert J. Spar
*Assistant Examiner*—Stuart J. Millman
*Attorney, Agent, or Firm*—Banner, Birch, McKie & Beckett

[57] ABSTRACT

A bottom discharge hopper includes an elongated rectangular discharge opening closable by two discharge doors hinged along their outer edges to the hopper so that the doors are biased to an open position. Each door includes control means comprising a biasing member pivotally mounted to the hopper which biases a runner at each end of the door along a runner track on the door towards a position corresponding to the closed position of the door, the runners being located substantially directly below the pivot of the biasing member in this closed position.

8 Claims, 3 Drawing Sheets

BOTTOM DISCHARGE HOPPER

This invention relates to hoppers of the type used to convey ore and the like in the mining industry, and particularly to hoppers of the type known as "bottom discharge hoppers".

Bottom discharge hoppers may be distinguished from side discharge hoppers in that they are adapted to discharge their load through an aperture in the bottom thereof and between the rail wheels of the hopper. Side discharge hoppers, as their name implies are adapted to discharge their loads from a side door and to the side of the hopper.

The doors and door opening mechanisms for hoppers have been the subject of much design work and many patent applications have been filed therefore, it being recognised that the rapid and complete discharge of hopper loads is essential.

An object of this invention is to provide a hopper which has these characteristics.

According to the invention a hopper comprises a load conveying body having an elongated bottom discharge aperture and mounted on a suitable wheeled chassis, the aperture being closable by at least one hinged door biased, by its own weight to an open position; and control means for the door including a runner track on the door transverse to its hinge axis, a runner to engage the runner track and movable between positions corresponding to open and closed positions of the door, the runner being mounted on a pivotal biasing member which is biased under its own weight to a position in which the runner corresponds to the closed position of the door and to a position substantially directly below the pivot point of the door, the force of the door and any load thereon acting substantially downwardly on the runner; and means for moving the biasing member to a position in which the runner is moved to correspond with the open position of the door.

Further according to the invention the control means includes a runner track and runner at each end of the door with the biasing member extending there between; the biasing member including a pair of triangular end plates pivotally mounted to the ends of the hopper at one apex with a runner mounted on each of the end plates at a second apex and the plates being connected by a connecting member.

Still further according to the invention the means for moving the biasing member comprises a dolly wheel engageable with a suitable track.

Still further according to the invention the runner track configurations is such as to provide rapid opening and closing of the door over a short distance of measurement of the runner.

Still further according to the invention the door extends substantially horizontally in its closed position.

Still further according to the invention the force exerted by the biasing member is sufficient to overcome the bias on the door and to move it to its closed position.

Still further according to the inveniton the hopper includes a pair of doors hinged to opposite sides of the discharge opening with each door including its own control means.

An embodiment of the invention, described by way of example only, follows with reference to the accompanying drawings in which.

Figure 1:
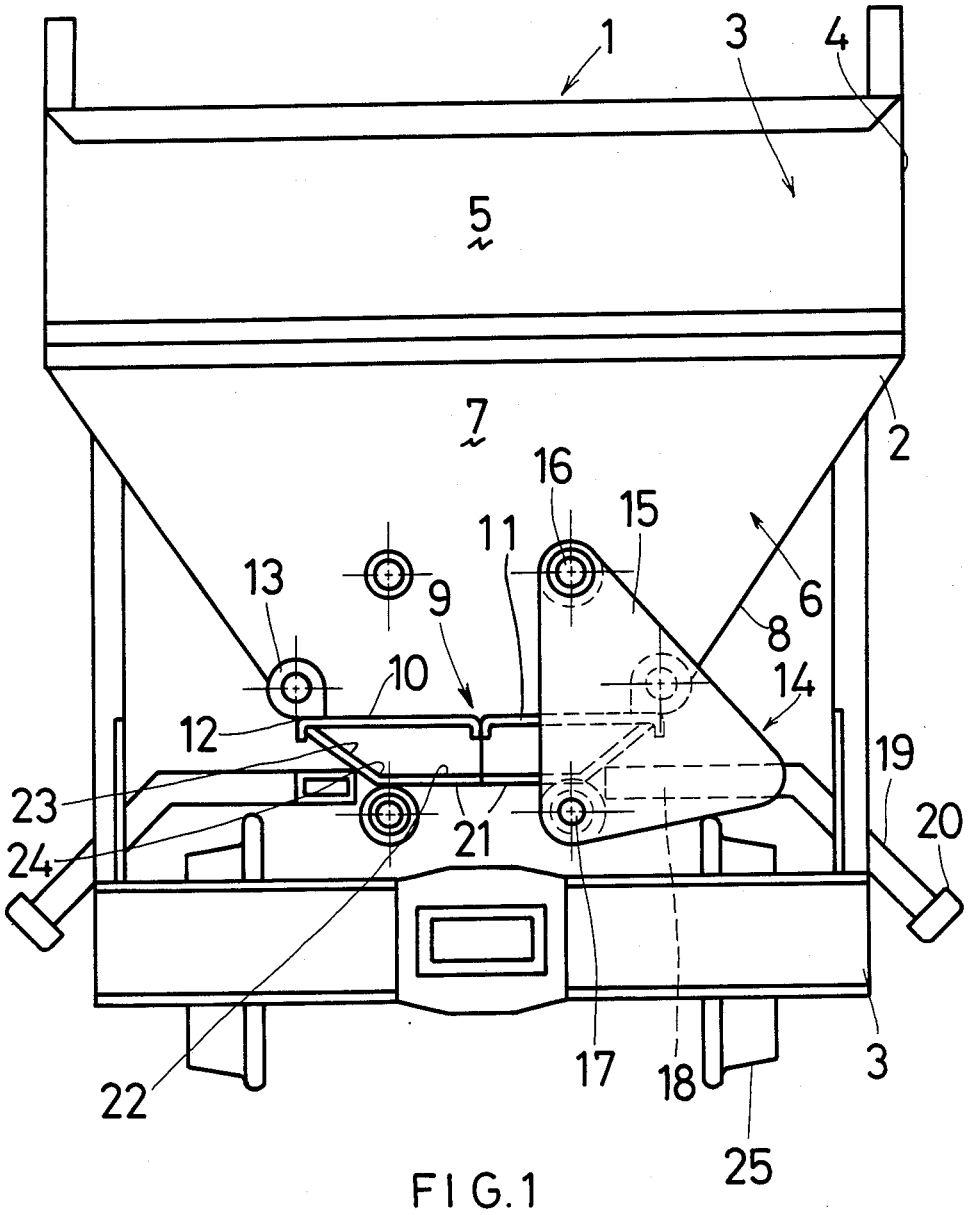
FIG. 1 is an end elevation of a hopper according to the invention with the discharge doors in the closed position and part of the control means for one of the doors removed.

In this embodiment of the invention a bottom discharge hopper 1 of the type used to carry ore in underground mining operations comprises a load carrying body 2 which is permanently mounted in known manner on a chassis 3 including rail wheels 25. Elements of the chassis 3 will not be further described as they are well known in the art.

The load carrying body 2 is elongated and rectangular in plan view. It includes a top section 3 with substantially vertical side and end walls 4 and 5 respectively and a lower section 6 having vertical end walls 7 and sloping side walls 8.

The body 2 terminates at its bottom in an elongated rectangular discharge opening indicated generally be numeral 9. This discharge opening is closable by means of a pair of discharge doors 10 and 11 which are mounted along their outer edges 12 by hinges 13 to the end member 7 of the body. The two doors 10 and 11 thus meet along their edges along the center line of the discharge opening.

Figure 2:
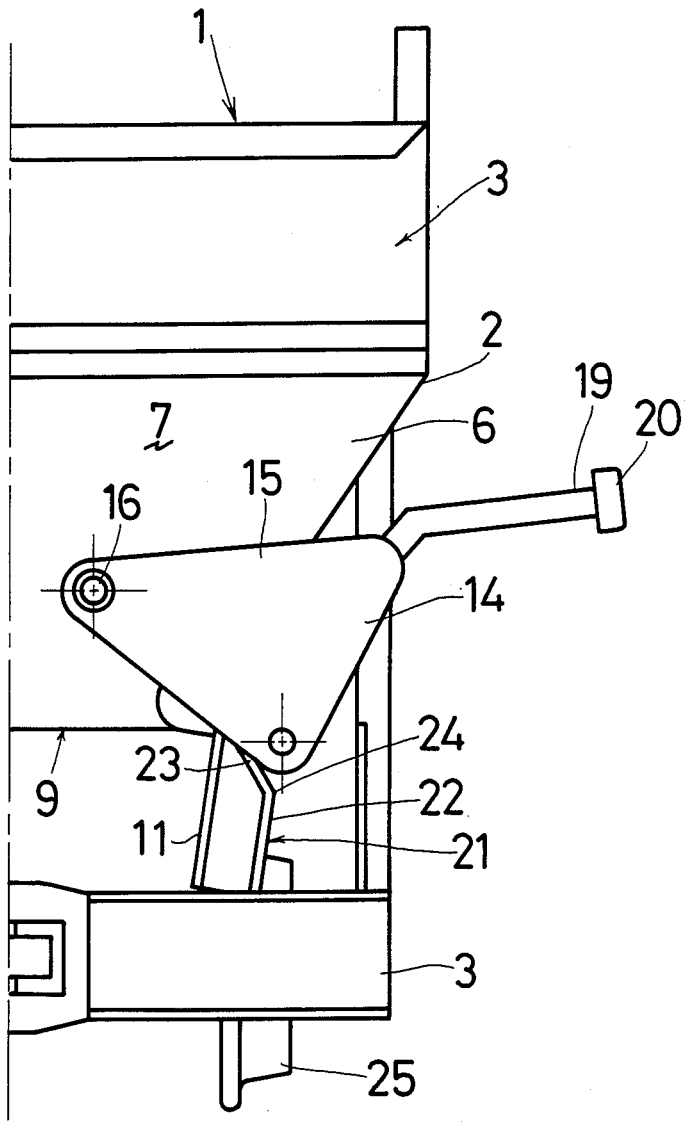
FIG. 2 is an end elevation of one half of the hopper of FIG. 1 with the door in an open position.
Figure 3:
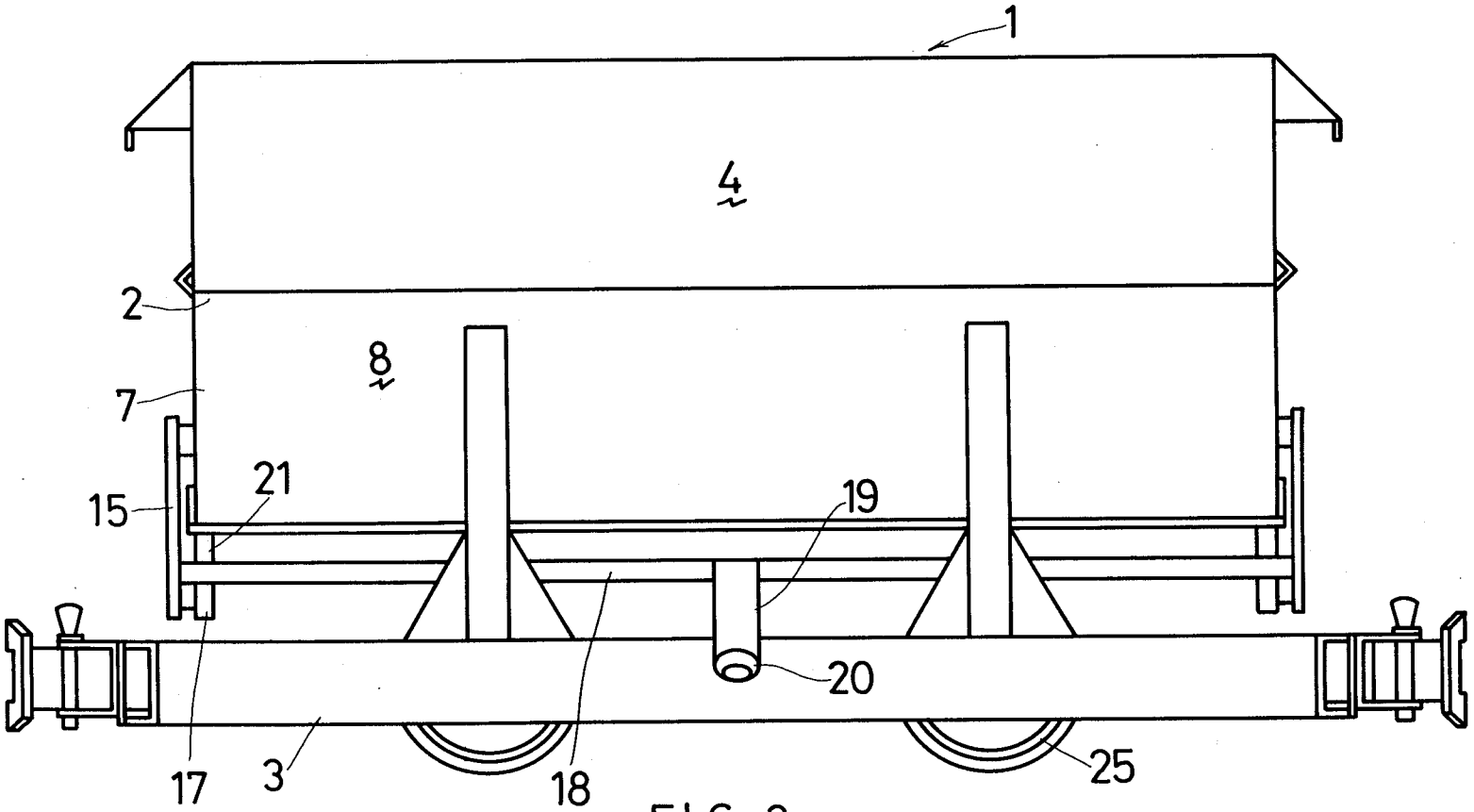
FIG. 3 is a side elevation of the hopper as shown in FIG. 1.

The doors 10 and 11 are pivotable about their hinge 13 axes between a closed position as shown in FIG. 1 in which they are substantially horizontal and an open position as shown in FIG. 2 in which they hang downwardly in a generally vertical orientation. It will be appreciated that their weight and hinged configuration ensures that they are biased towards the open position shown in FIG. 2.

In order to maintain the doors in a closed position and allow them to move to an open position control means indicated generally by numeral 14 are provided.

The control means 14 for each door comprises a pair of heavy congruent triangular end plates 15 mounted to the opposite ends 7 of the body 2 by pivotal mountings 16 located at one of the apexes of each plate.

At the inwardly positioned of the two remaining apexes of each plate is mounted a rotatable runner 17 it being appreciated that the weight of the end plates will tend to move the runner 17 inwardly towards the center line of the hopper discharge opening until a stable position is reached.

The two end plates for each door are connected by means of a connecting member 18 and to this connecting member 18 an outwardly extending arm 19 terminating in a dolly wheel 20 is connected. The dolly wheel may engage a suitable track (not shown) to rotate the control means and hence the end plates and runners 17 about the pivot points 16.

The runners 17 engage runner tracks 21 located at, and integral with, each end of each of the doors 10 and 11. The runner tracks 21 comprise inner portion 22 which is substantially parallel to the plane of the doors and an inclined portion 23 which extends from the edge 24 of the inner portion to the edge 12 of the door.

Referring to FIG. 1 of the drawings it is to be noted that the pivot points 16 of the control means 14 are positioned such that when the respective door is in the closed position they are located directly above the inner portion 22 of the runner tracks 21 but adjacent the outer edges 24 thereof. Thus when a corresponding runner 17 is located below the pivot point 16 it will bear against the runner track 21 on this inner flat portion 22 thereof.

Thus in this position the weight of the door as well as the load carried by that door will act directly downwardly on the runners 17 which being immediately below the pivot point 16 will not tend to move in a sideways and upwards direction to allow the doors to open.

Being immediately adjacent the edge 24 of the portion 22 of the runner tracks a small movement of the runners 17 will cause them to move onto the inclined portion 23 the incline of which provides for rapid opening of the doors. In this position the opening of the doors is assisted by the force of the load carried thereby which tends to override the closing bias provided by the weight of the control means 14. This operation is naturally initiated by the movement of the hopper through a discharge station during which the dolly wheel 20 engages a suitable track thereby moving the runners 17 onto the inclined portion 23.

Once the hopper has discharged its load in the manner described above and the upward force on the dolly wheels 20 is released, the weight of the control member overrides the biasing weight of the doors 10 and 11 forcing the runners 17 up the inclined portion 23 closing the door until the parallel horizontal portion 22 is reached in which position the doors are once again closed with the runners 17 directly below the pivot points 16.

It will be appreciated that the invention provides a bottom discharge hopper of relatively simple construction and which is able to discharge its load rapidly and effectively. It is also of reasonably robust design in order to decrease the likelihood of damage thereto as well as the effects of any such damage as may be sustained.

Other embodiments are envisaged within the scope of the invention including other configurations and applications thereof.

We claim:

1. A hopper comprises a load carrying body having an elongated bottom discharge aperture and mounted on a suitable wheeled chassis, the aperture being closable by at least one hinged door biased, by its own weight to an open position; and control means for the door including a runner track on the door transverse to its hinge axis, a runner to engage the runner track and movable between postions corresponding to open and closed positions of the door, the runner being mounted on a pivotally mounted biasing member which is biased under its own weight to a position in which the runner corresponds to the closed position of the door and to a position directly below the pivot point of the biasing member, the force of the door and any load thereon acting substantially downwardly on the runner; and means for moving the biasing member to a position in which the runner is moved to a position corresponding with the open position of the door.

2. A hopper as claimed in claim 1 in which the control means for the door includes a biasing member and a runner and runner track at each end of the door.

3. A hopper as claimed in claim 2 in which the biasing member includes a pair of triangular end plates pivotally mounted to the ends of the hopper at one apex with a runner mounted on each of the end plataes at a second apex and the plates being connected by a connecting member.

4. A hopper as claimed in claim 1 in which the means for moving the biasing member comprises a dolly wheel engageable with a suitable track.

5. A hopper as claimed in claim 1 in which the runner track configuration is such as to provide rapid opening and closing of the door over a short distance of measurement of the runner.

6. A hopper as claimed in claim 1 in which the door extends substantially horizontally in the closed position.

7. A hopper as claimed in claim 1 in which the force exerted by the biasing member is sufficient to overcome the bias on the door and to move it to its closed postion.

8. A hopper as claimed in claim 1 which includes a pair of doors hinged to opposite sides of the discharge opening with each door including its own control means.

* * * * *